US011188013B2

(12) United States Patent
Tanchak et al.

(10) Patent No.: US 11,188,013 B2
(45) Date of Patent: Nov. 30, 2021

(54) PHOTORECEPTOR STRIPPER FINGERS WITH AN IMPROVED PROFILE FOR ULTRA-LIGHT WEIGHT MEDIA

(71) Applicant: XEROX CORPORATION, Norwalk, CT (US)

(72) Inventors: Rachel Lynn Tanchak, Rochester, NY (US); Shawn R Rowan, Dansville, NY (US); Erwin Ruiz, Rochester, NY (US); Michael L Povio, Webster, NY (US); Michael N Soures, Rochester, NY (US); Arthur H Kahn, New York, NY (US)

(73) Assignee: Xerox Corporation, Norwalk, CT (US)

( * ) Notice: Subject to any disclaimer, the term of this patent is extended or adjusted under 35 U.S.C. 154(b) by 131 days.

(21) Appl. No.: 16/683,658

(22) Filed: Nov. 14, 2019

(65) Prior Publication Data

US 2021/0149328 A1 May 20, 2021

(51) Int. Cl.
*G03G 15/20* (2006.01)
*G03G 15/00* (2006.01)

(52) U.S. Cl.
CPC ..... *G03G 15/2028* (2013.01); *G03G 15/6532* (2013.01); *G03G 15/6594* (2013.01); *G03G 2215/004* (2013.01); *G03G 2215/00485* (2013.01); *G03G 2215/00544* (2013.01); *G03G 2221/1675* (2013.01)

(58) Field of Classification Search
CPC ..... G03G 15/2028; G03G 15/6532; G03G 15/6594; G03G 2215/004; G03G 2215/00485; G03G 2215/00544; G03G 2221/1675
See application file for complete search history.

(56) References Cited

U.S. PATENT DOCUMENTS 7,515,868 B2 * 4/2009 Miller ..... G03G 15/6532 101/118
2012/0051826 A1 * 3/2012 Barton ..... G06F 1/169 400/644

* cited by examiner

*Primary Examiner* — Joseph S Wong

(57) ABSTRACT

An apparatus for stripping light weight and ultra-light weight media from a photoreceptor that is tacked thereto by electrostatic or vacuum force includes a set of low-tip stripper fingers configured to strip the light weight and ultra-light weight media from the photoreceptor. The low-tip stripper fingers are adjustable both in the cross process and in attack angle with respect to the photoreceptor in order to change the height at which the tip of each stripper finger is in relation to the photoreceptor and thereby prevent jams due to miss-strips. Additionally, dual stripper fingers are disclosed that support inboard and outboard edges of larger media in order to reduce dog ears and jams.

18 Claims, 11 Drawing Sheets

PHOTORECEPTOR STRIPPER FINGERS WITH AN IMPROVED PROFILE FOR ULTRA-LIGHT WEIGHT MEDIA

BACKGROUND

Disclosed is an apparatus for stripping light weight and ultra-light weight media from a photoreceptor, and more particularly, to improved stripper fingers for handling a variety of media weights.

In a typical electrostatographic printing process, a photoconductive member or photoreceptor is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the information areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Generally, printing machines employing this process or an ink jet process utilize cut sheets of paper advanced though the printing machine, one sheet at a time, for suitable processing therein. Sheets are advanced through the printing machine by transport subsystems and are stripped from the photoconductive member or photoreceptor by stripper fingers and transported to an output device, such as, a stacker. Presently, photoreceptor stripper fingers, as shown in U.S. Pat. No. 7,515,868 B2, which is incorporated herein by reference are not always able to reliably strip ultra-light weight media (below 75 gsm and as low as 44 gsm) off the photoreceptor resulting in jams and media damage. This is due to lack of stiffness in the media and the media being more sensitive to media damage, such as, dog ears and jams at the photoreceptor stripper fingers, as well as, as at the media stacker, inverter, fuser and other subsystems post-photoreceptor stripper fingers.

Obviously, there is still a need for stripper fingers positioned at photoreceptor strip rolls that can handle ultra-light weight media.

SUMMARY

Accordingly, in answer to this need, disclosed herein is a specified stripper finger configuration for stripping ultra-light weight media from a photoreceptor belt that includes positioning stripper fingers in a predetermined location in relation to the tangent of a photoreceptor media strip roll. A set of dual fingers is located on the inboard and outboard edges of the stripper finger configuration for additional support for ultra-light weight wide media to prevent jams and media damage, such as, dog ears.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
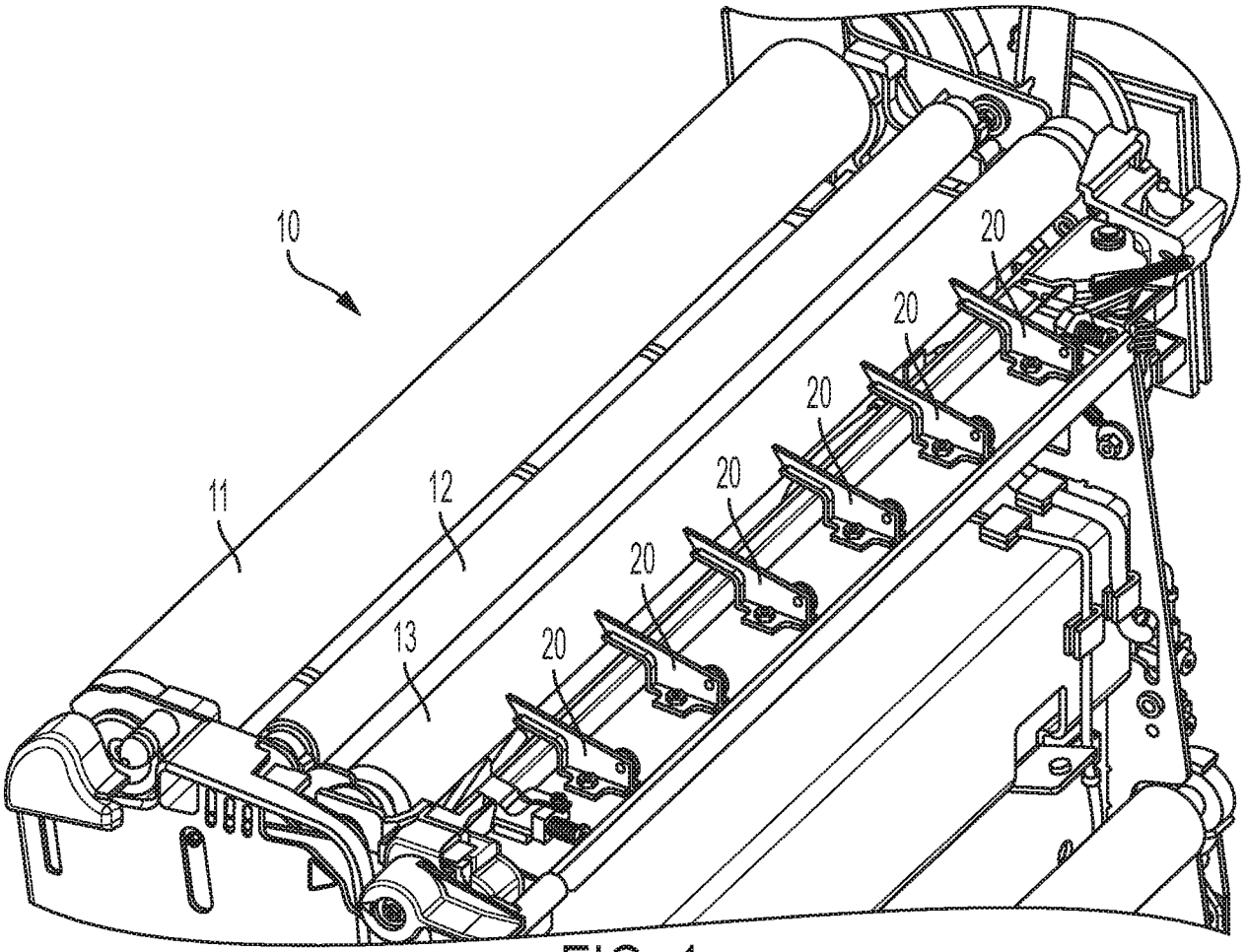
FIG. 1 PRIOR ART
FIG. 1 is partial perspective view of a printer that includes a set of prior art stripper fingers positioned to strip media from a photoreceptor.

For a general understanding of the features of the disclosure, reference is made to the drawings. In the drawings, like reference numerals have been used throughout to identify identical elements.

Figure 2:
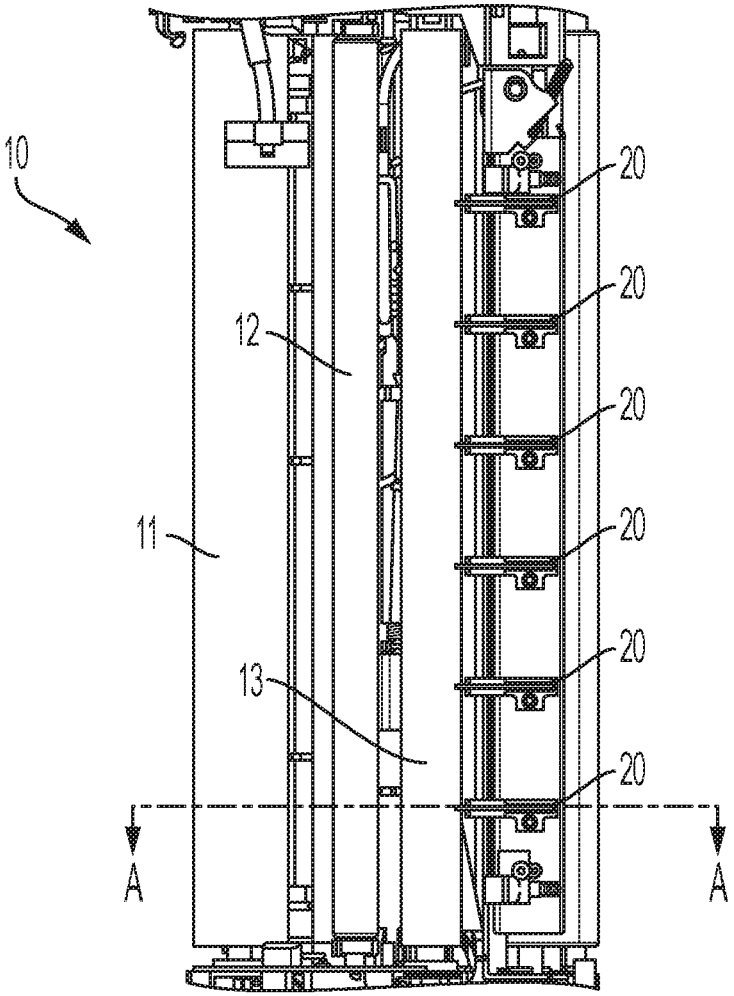
FIG. 2 PRIOR ART
FIG. 2 is a plan view of the partial printer of FIG. 1 showing the location of section line A-A.
Figure 3:
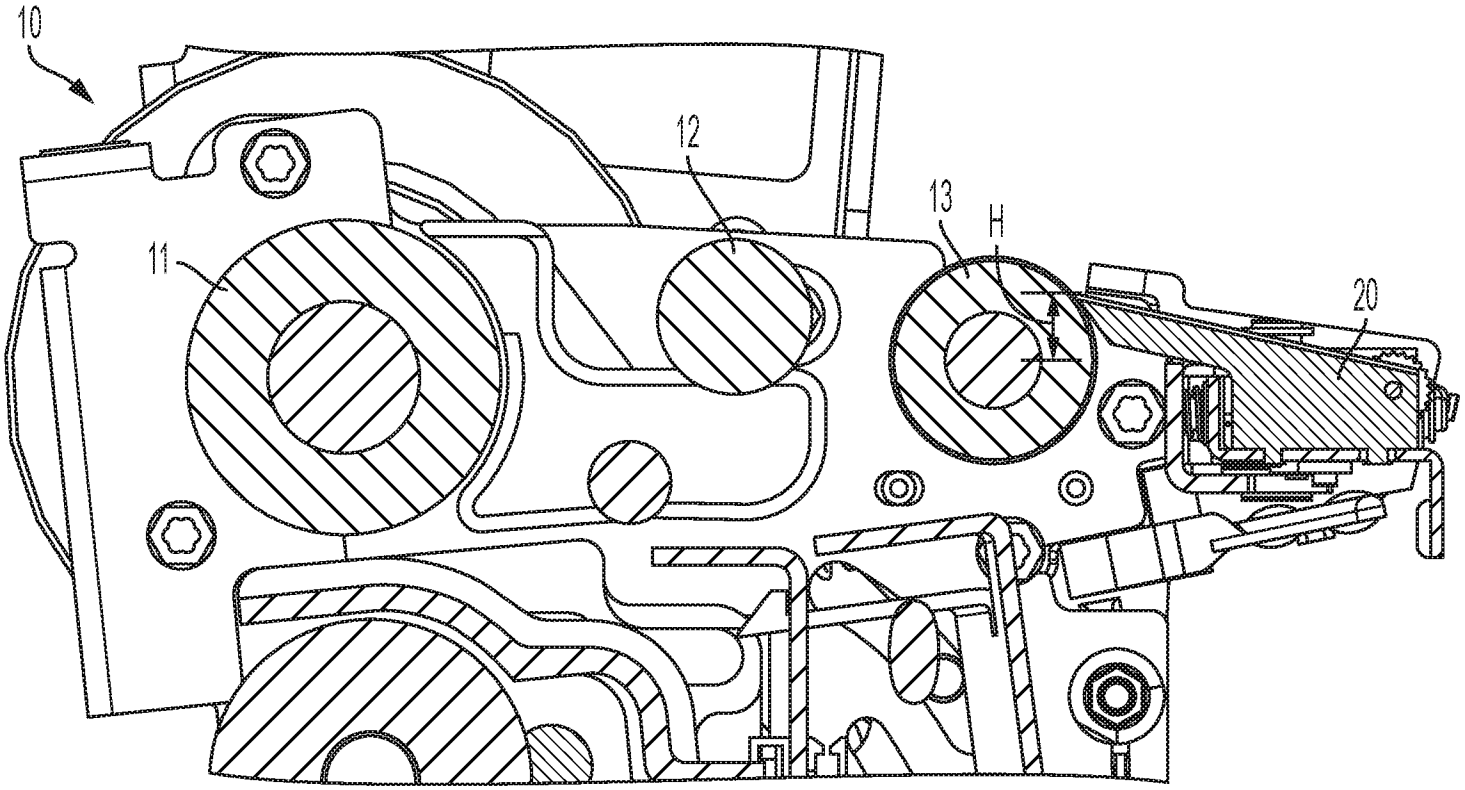
FIG. 3 PRIOR ART
FIG. 3 is a section A-A side view of the partial printer of FIG. 2 showing the height from the center of the photoreceptor strip roll to the tip of a stripper finger.
Figure 4:
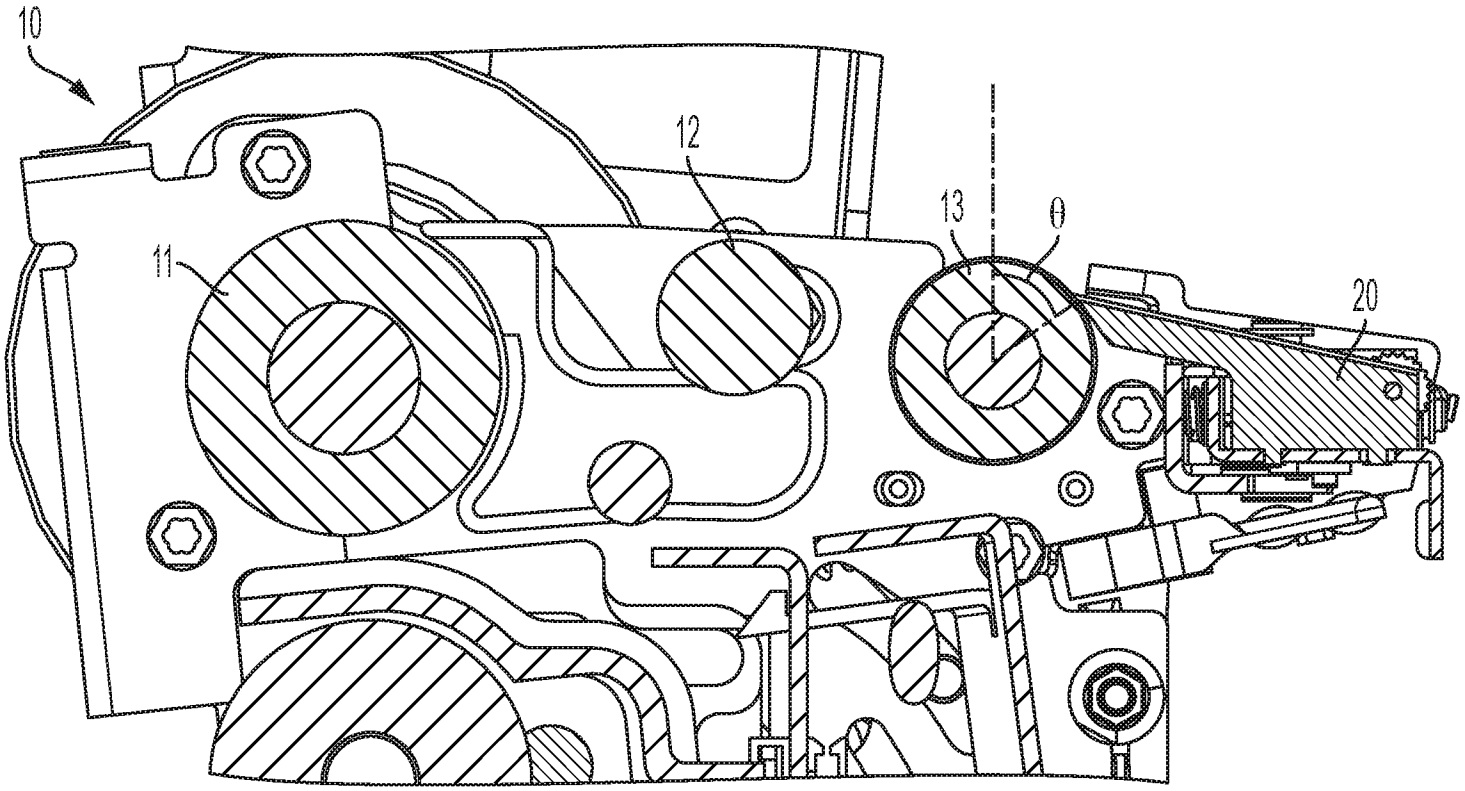
FIG. 4 PRIOR ART
FIG. 4 is a side view of the partial printer of FIG. 2 viewed along section A-A showing the angle of the photoreceptor strip roll to the tip of a photoreceptor stripper finger.
Figure 5:
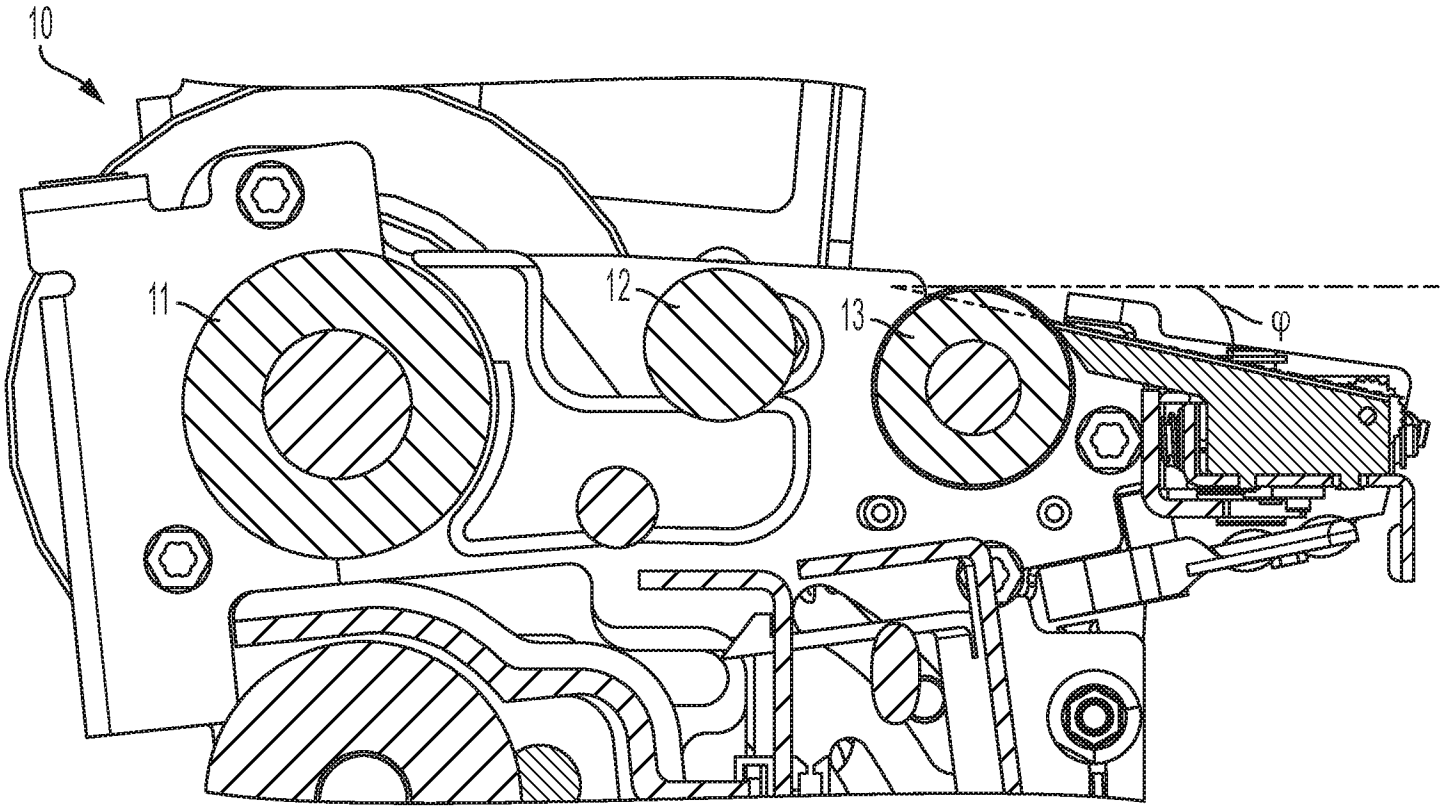
FIG. 5 PRIOR ART
FIG. 5 is a side view of the partial printer of FIG. 2 viewed along section A-A showing the angle from the horizontal tangent of the photoreceptor strip roll to the top surface of a photoreceptor stripper finger.

Referring now to FIG. 1, there is shown a partial perspective view of a printer 10 that includes an existing stripper assembly with incorporated stripper fingers 20. Media is conveyed by transport rollers 11 and 12 over strip roll 13 which supports an entrained photoreceptor (not shown) for rotational movement in a clockwise direction. The media is separated for downstream conveyance from strip roll 13 by fingers 20. A plan view of FIG. 1 is shown in FIG. 2 that shows the location of a sectional view along line A-A. FIG. 3 shows the current positioning of stripper fingers within a printer for media stripping purposes. In FIG. 3, stripper finger 20 is positioned with respect to strip roll 13 such that the height (H1) from the center of photoreceptor strip roll 13 to the tip of finger 20 is about 8.35 mm. As shown in FIG. 4, the angle (θ) of photoreceptor strip roll 13 in relation to the tip of photoreceptor stripper finger 20 is about 50.9 degrees. In FIG. 5, an angle (φ) is shown encompassing the horizontal tangent of photoreceptor strip roll 13 to a top surface of photoreceptor strip finger 20 and includes 12.3 degrees. With the heretofore-mentioned parameters, stripper fingers 20 are not able to reliably strip ultra-light weight media (below 75 gsm and as low as 44 gsm) off a photoreceptor belt resulting in jams and media damage. Ultra-light weight media has a lower beam stiffness and droops more than heavier media, for example, above 75 gsm. Stripper fingers 20 have a profile that allows ultra-light weight media to slip down into a gap formed between photoreceptor strip roll 13 and the stripper fingers resulting in jams and dog ears. Media that does not jam at the photoreceptor stripper fingers can cause additional risks of jams downstream, especially in the stacker and fuser. For media weight of 75 gsm and heavier, the media is able to jump the gap, or be stripped away from the fingers.

Figure 6:
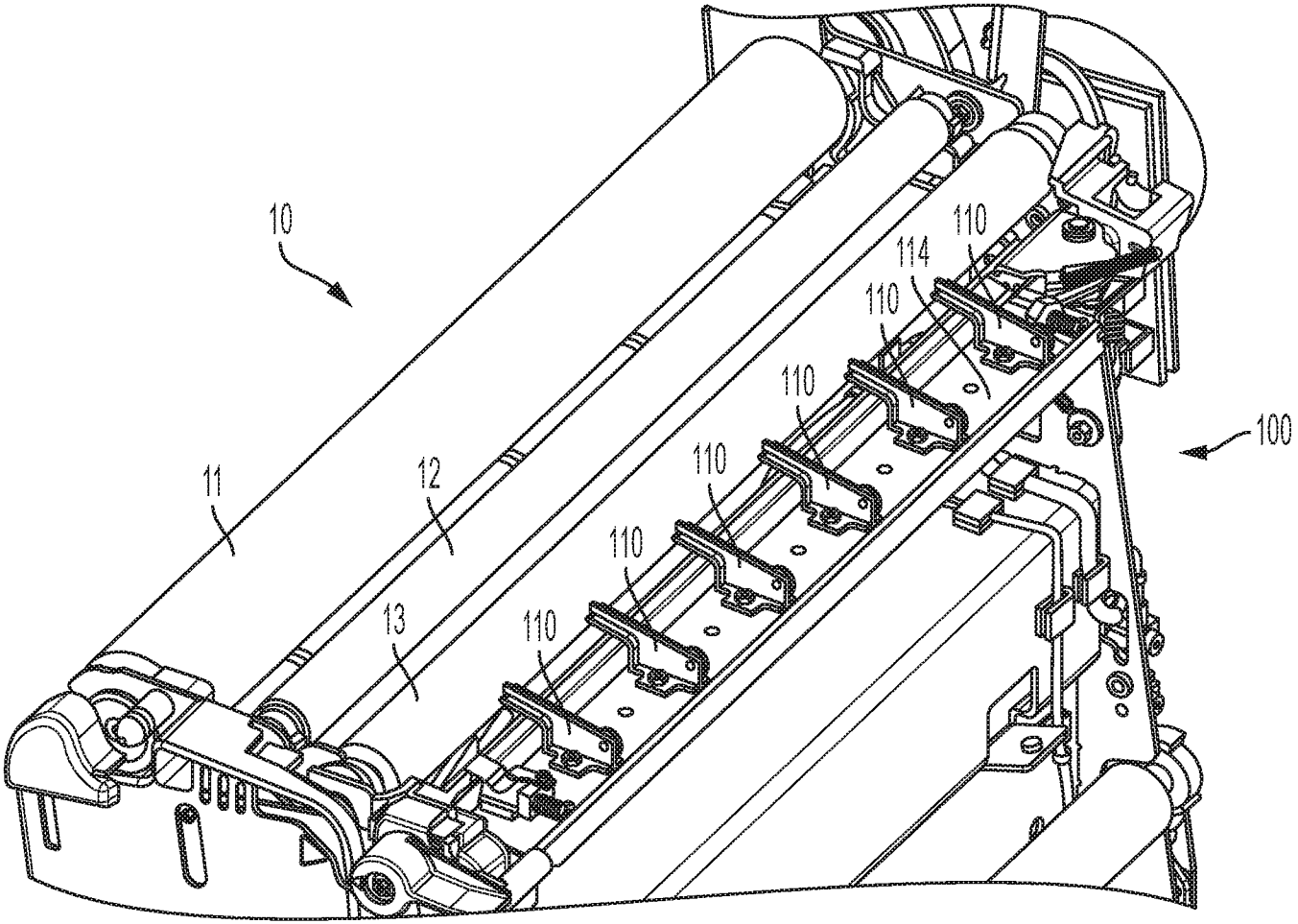
FIG. 6 is a perspective view of the partial perspective printer view of FIG. 1 that includes a set of improved low-tip stripper fingers in accordance with the present disclosure positioned to reliably strip media from a photoreceptor.
Figure 7:
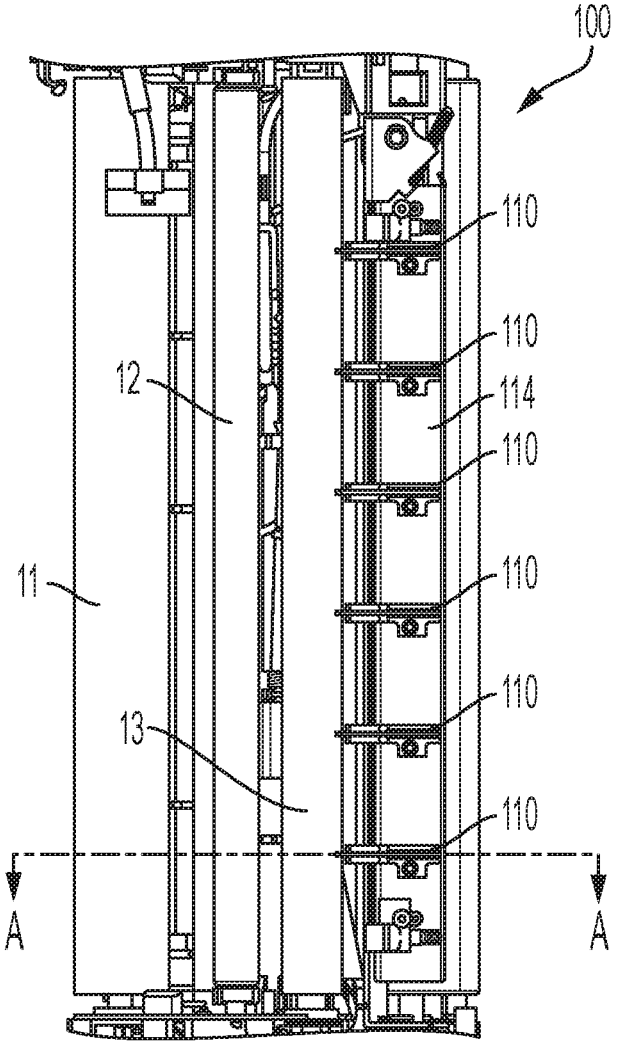
FIG. 7 is a plan view of the partial printer of FIG. 6 showing the location of section line A-A.
Figure 8:
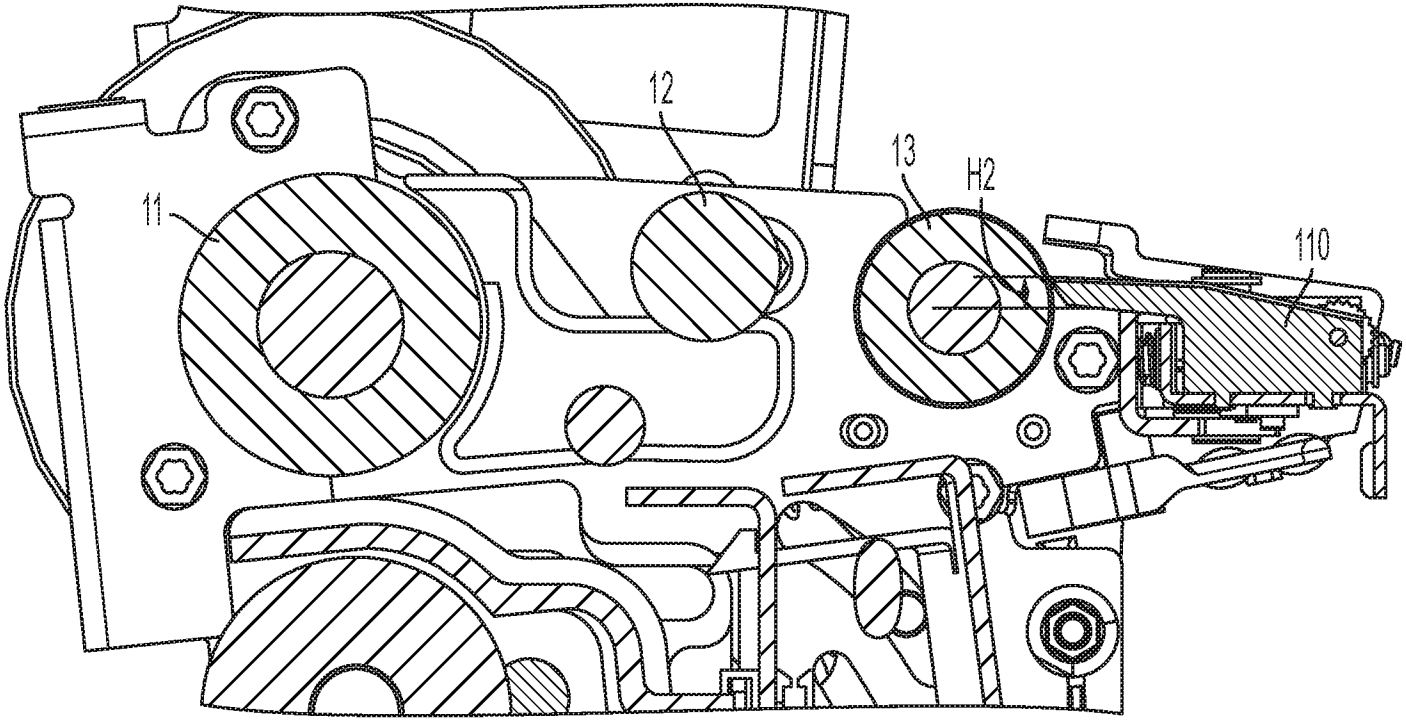
FIG. 8 is a side view of the partial printer of FIG. 7 viewed along section A-A showing the height from the center of the photoreceptor strip roll to the tip of a stripper finger.
Figure 9:
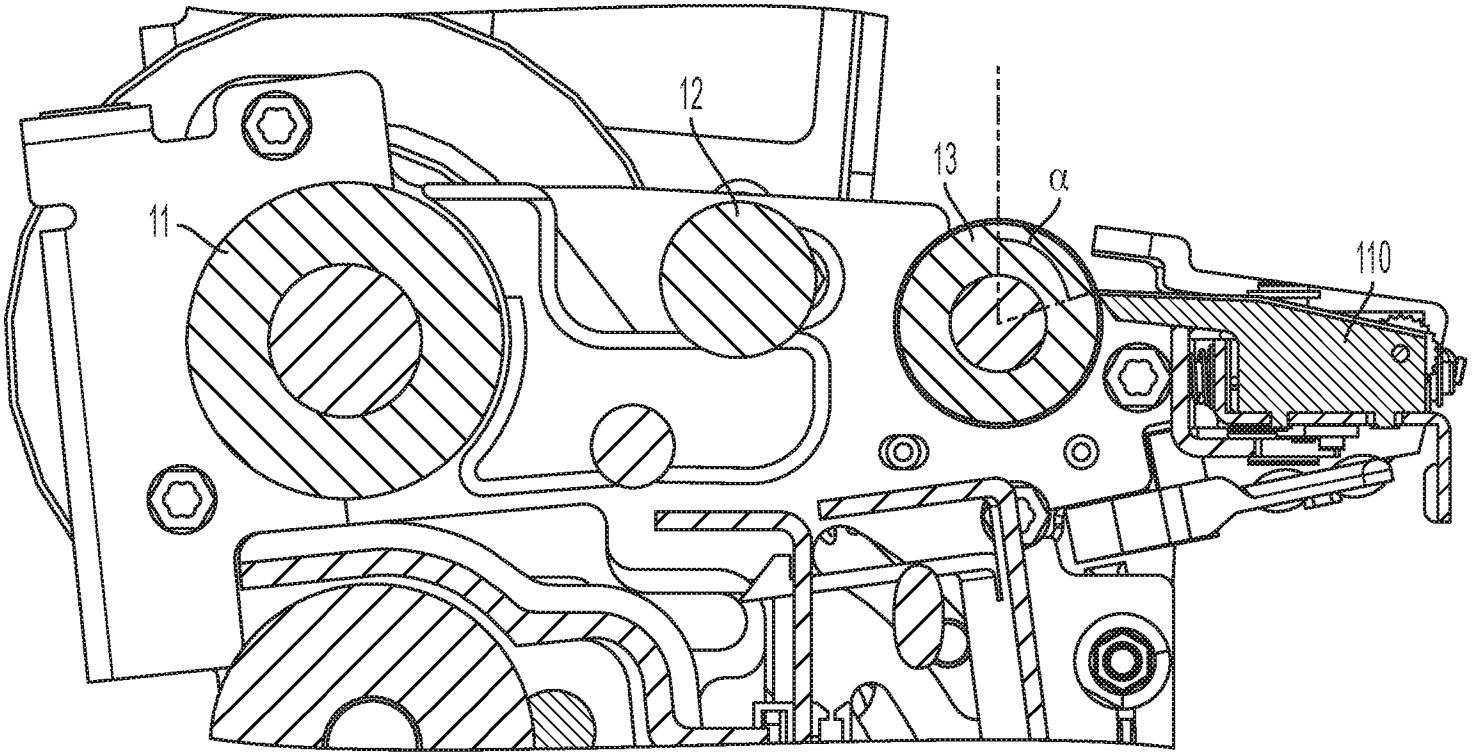
FIG. 9 is a side view of the partial printer of FIG. 7 viewed along section A-A showing the angle of the photoreceptor strip roll to the tip of the photoreceptor strip finger.
Figure 10:
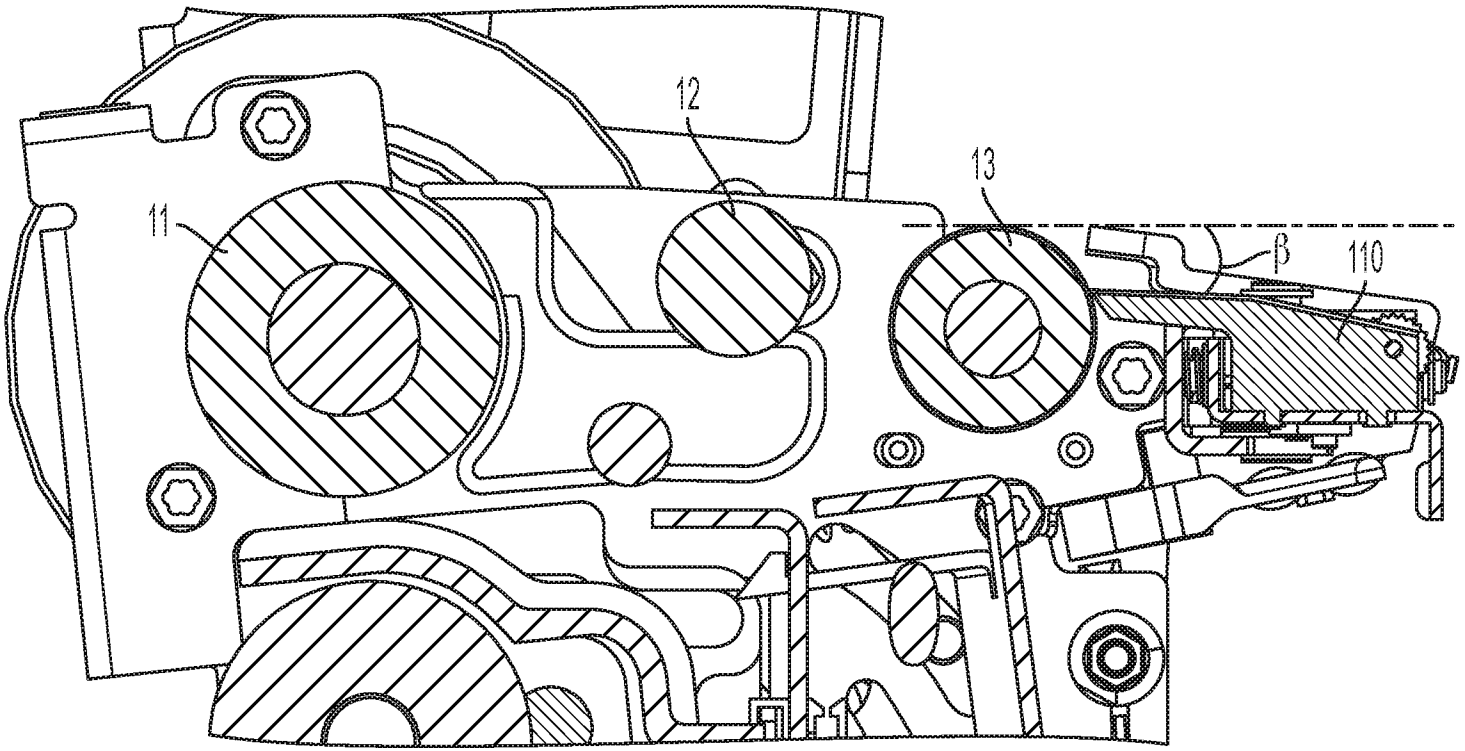
FIG. 10 is a side view of the partial printer of FIG. 7 viewed along section A-A showing an angle from the horizontal tangent of the photoreceptor strip roll to the top surface of the photoreceptor strip finger.

In accordance with the present disclosure, an improved stripper finger apparatus 100 is shown that accommodates stripping a wide variety of media from a photoreceptor including media at, above and below 75 gsm. The improved stripper finger apparatus 100 in FIGS. 6 and 7, includes a support assembly 114 that supports a series of lower profiled, low-tip stripper fingers 110 that are configured to accommodate stripping media conveyed by a photoreceptor supported and rotated by strip roll 13. The lower profiled photoreceptor stripper fingers change the height at which the tip of each of the low-tip stripper fingers 110 is in relation to photoreceptor stripping roll 13. For ultra-light weight media, the lower profile allows the media to be stripped further down a photoreceptor belt preventing it from slipping through the gap between the photoreceptor belt and low-tip stripper fingers. In addition, as shown in FIG. 8, low-tip stripper finger 110 includes a height (H2) from the center of strip roll 13 to the tip of low-tip stripper finger 110 of about 3.55 mm and, as shown in FIG. 9, includes an angle alpha represented by a vertical line through a center portion of photoreceptor strip roll 13 intersected by a line from a center portion of strip roll 13 that extends past a tip of low-tip stripper finger 110 of about 74.4 degrees. A further improvement is shown in FIG. 10 that includes an angle beta from a horizontal tangent of the strip roll 13 to a top surface of the low-tip stripper finger 110 of about 0.4 degrees.

Figure 11:
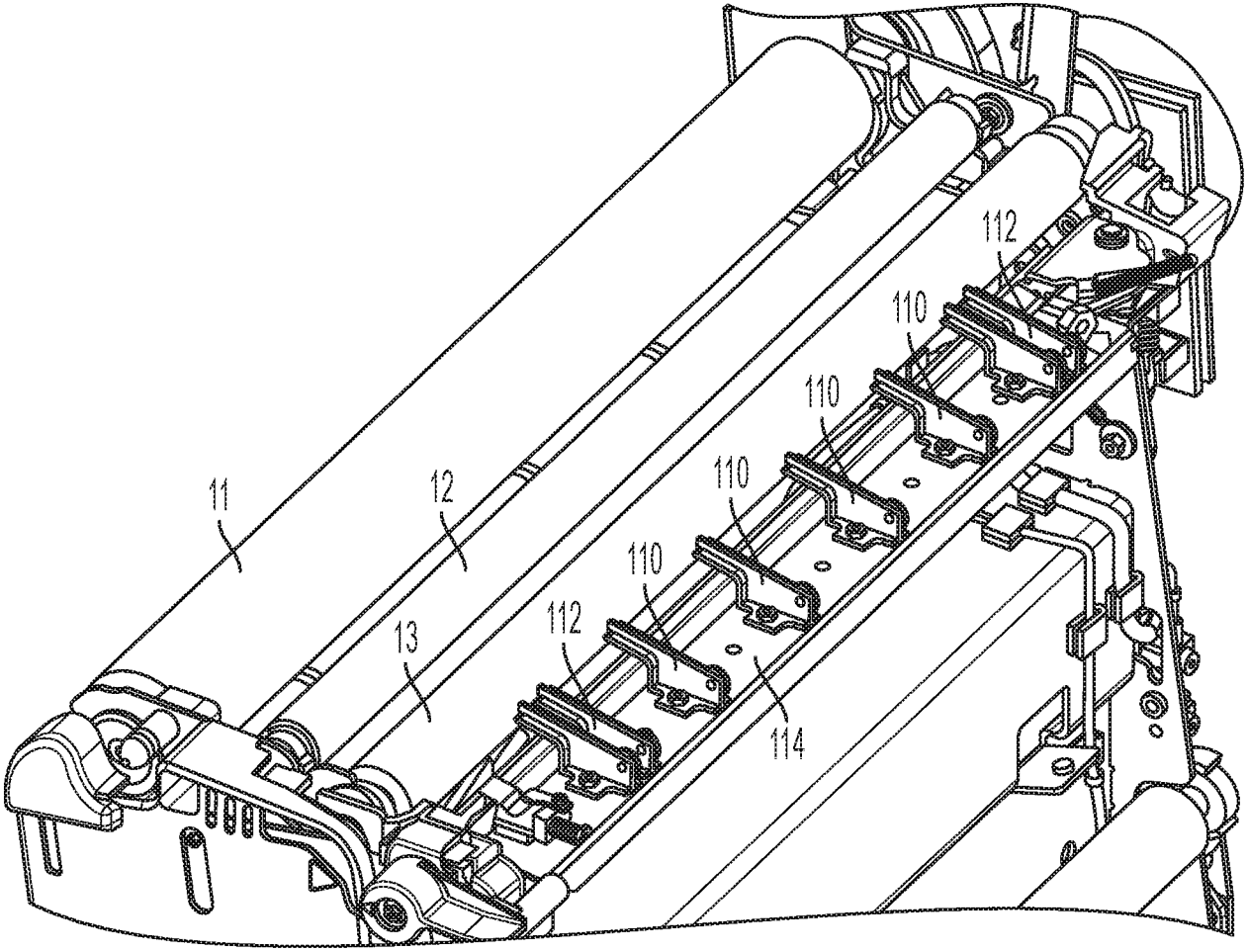
FIG. 11 is perspective view of the partial perspective printer view of FIG. 7 that includes dual low-tipped stripper fingers for stripping wide and ultra-wide media from a photoreceptor in accordance with the present disclosure.

In another embodiment in FIG. 11, a media stripping improvement is shown in accordance the present disclosure that accommodates stripping wide light and ultra-light weight media from a photoreceptor that includes dual low-tip stripper fingers 112 positioned on inboard and outboard edges of stripper finger support assembly 114 and bracketing a series of single, low-tip stripper fingers 110 for additional media edge support. This arrangement addresses evidence that dog ears occur at inboard or outboard locations of strip roll 13 due to miss-strips. That is, the media goes under the inboard or outboard finger and then bends backward as the body of the media is transported. Media boundary conditions at the inboard and outboard positions are completely free and the corners are very compliant. Thus, the dual fingers allow the inboard and outboard edges of larger media to be supported which reduces dog ears and jams.

It should be understood that low-tip stripper fingers 110 and 112 are also configured for rotation to manipulate the attack angle of the low-tip stripper fingers with respect to a photoreceptor mounted on strip roll 13 by conventional means, such as, a rack and pinion or cam/linkage mechanism to force low-tip stripper fingers 110 and 112 to rotate around a virtual radius that starts at the center of strip roll 13. Low-tip fingers 110 and 112 are also adjustable in a cross-process direction to assist in preventing dog ears and to avoid any larger than necessary span of unsupported media through placement of additional holes in the stripper finger support assembly 114 so that the low-tip stripper fingers can be removed and re-inserted into different positions. In addition, the low-tip stripper fingers can vary within a given configuration. For example, when viewing the low-tip stripper fingers in FIG. 7 from outboard to inboard from 1-6, low-tip stripper fingers 1 and 6 could have the lowest tip, low-tip stripper fingers 2 and 5 could have the second lowest tip and low-tip stripper fingers 3 and 4 would have the existing profile shown in FIGS. 8 through 10. In this manner, paper would be free to sag more on the inboard and outboard locations and could strip at a later point in time when moving from center to end. This would also help prevent folds at its corners (dog ears). A most expedient stripper finger varying implementation would be to have only three different tip heights and snap the stripper fingers in or out of support assembly 114 as necessary by an end user.

In recapitulation, a reliable apparatus and method has been disclosed for stripping light weight and ultra-light weight media from a photoreceptor belt or drum that is tacked thereto by electrostatic or vacuum forces and includes a set of improved low-tip stripper fingers configured to strip light weight and ultra-light weight media from the photoreceptor. The low-tip stripper fingers have a lower profile than current stripper fingers and are adjustable both in cross process and attack angle with respect to the photoreceptor in order to prevent jams due to miss-strips. The low profiled, low-tip stripper fingers change the height at which a tip of a stripper finger is in relation to the photoreceptor stripping roll and can be mounted to an existing stripper finger bracket. Additionally, dual stripper fingers are disclosed that support inboard and outboard edges of larger media in order to reduce dog ears and jams.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A printing machine including a stripper arrangement for removing light weight and ultra-light weight media from a photoreceptor belt, comprising:

a strip roll configured to support a photoreceptor belt for rotational movement;

a set of low-tip stripper fingers mounted on a support and configured to strip media presented thereto by rotation of said strip roll; and wherein said low-tip stripper fingers include a profile where a height from the center of said strip roll to a tip of each of said low-tip stripper fingers is about 3.55 mm.

2. The printing machine of claim 1, wherein an angle from a horizontal tangent of said strip roll to a top surface of each of said low-tip stripper fingers is about 0.4 degrees.

3. The printing machine of claim 2, wherein an angle represented by a vertical line through a center portion of said strip roll is intersected by a line from a center portion of said strip roll that extends past a tip of said low-tip stripper fingers of about 74.4 degrees.

4. The printing machine of claim 3, wherein said set of low-tip stripper fingers include dual low-tip stripper fingers positioned on inboard and outboard edges of a stripper finger support assembly and bracketing a series of single, low-tip stripper fingers for additional media edge support.

5. The printing machine of claim 4, wherein each of said low-tip stripper fingers is repositionable on said support.

6. The printing machine of claim 5, wherein height of said low-tip stripper fingers is adjustable with respect to a center portion of said strip roll.

7. The printing machine of claim 6, wherein said low-tip stripper fingers are adjustable in a cross-process direction.

8. A printing machine including a stripper assembly arranged to strip a light and ultra-light weight media sheet from a photoreceptor, comprising:

a strip roll on which said photoreceptor is mounted;

a series of low-tip stripper fingers positioned in close proximity to said strip roll with each of said series of low-tip stripper fingers including a protruding distal stripping end and an opposite stripping finger base end, with an upper media stripping surface extending therebetween, so that the corresponding finger distal stripping end extends towards said strip roll to thereby form a gap therewith; and wherein said series of low-tip stripper fingers is configured such that a height from a center of said strip roll to said protruding distal stripping end of each of said series of low-tip stripper fingers is about 3.55 mm.

9. The printing machine of claim 8, wherein said low-tip stripper fingers are configured for rotation to manipulate the attack angle of said low-tip stripper fingers with respect to said photoreceptor to force said low-tip stripper fingers to rotate around a virtual radius that starts at a center of said strip roll.

10. The printing machine of claim 9, wherein angles between said strip roll and tips of said stripper fingers are configured to vary within a given configuration.

11. The printing machine of claim 10, wherein said series of low-tip stripper fingers include six fingers with fingers one and six having the lowest tip, low-tip stripper fingers two and five having the second lowest tip and low-tip stripper fingers three and four having a different profile.

12. The printing machine of claim 8, wherein said series of low-tip stripper fingers include a pair of dual low-tip stripper fingers positioned on inboard and outboard edges of a stripper finger support assembly and bracketing a series of single, low-tip stripper fingers for additional media edge support.

13. The printing machine of claim 12, wherein said dual low-tip stripper fingers are rotatable.

14. The printing machine of claim 8, wherein said protruding distal stripping ends of said series of low-tip stripper fingers are adjustable.

15. A method for removing light weight and ultra-light weight media from a photoreceptor in a printer, comprising:

providing a strip roll supporting said photoreceptor;

providing a set of low-tip stripper fingers mounted on a support and forming a gap with said strip roll; and providing said low-tip stripper fingers with a profile such that a height from a center of said strip roll to a tip of each of said low-tip stripper fingers is about 3.55 mm.

16. The method of claim 15, including configuring said low-tip stripper fingers for rotation in order to manipulate an attack angle of said low-tip stripper fingers with respect to said photoreceptor.

17. The method of claim 15, including providing a stripper finger support assembly for said low tip stripper fingers and inserting said low tip stripper fingers into and removing said low tip stripper fingers from said support assembly at different heights with respect to a center portion of said photoreceptor.

18. The method of claim 15, including providing said support assembly with a pair of dual low-tip stripper fingers positioned on inboard and outboard edges of said stripper finger support assembly and positioning a series of single, low-tip stripper fingers between said dual low-tip stripper fingers for media edge support.

* * * * *